US008091364B2

(12) United States Patent
Böttcher et al.

(10) Patent No.: US 8,091,364 B2
(45) Date of Patent: Jan. 10, 2012

(54) COMBUSTION CHAMBER WALL, GAS TURBINE INSTALLATION AND PROCESS FOR STARTING OR SHUTTING DOWN A GAS TURBINE INSTALLATION

(75) Inventors: Andreas Böttcher, Ratingen (DE); Jens Kleinfeld, Mülheim an der Ruhr (DE); Claus Krusch, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1092 days.

(21) Appl. No.: 11/920,397

(22) PCT Filed: May 10, 2006

(86) PCT No.: PCT/EP2006/062181
§ 371 (c)(1),
(2), (4) Date: Nov. 13, 2007

(87) PCT Pub. No.: WO2006/120204
PCT Pub. Date: Nov. 16, 2006

(65) Prior Publication Data

US 2009/0094986 A1 Apr. 16, 2009

(51) Int. Cl.
*F02C 1/00* (2006.01)
*F02G 3/00* (2006.01)

(52) U.S. Cl. ..... 60/752; 60/796

(58) Field of Classification Search ..... 60/752, 60/796, 800, 778, 786, 755, 757, 758
See application file for complete search history.

(56) References Cited

U.S. PATENT DOCUMENTS

| | | | | |
|---|---|---|---|---|
| 2,622,395 | A * | 12/1952 | Bowden | 60/39.511 |
| 3,965,066 | A * | 6/1976 | Sterman et al. | 60/800 |
| 4,480,436 | A | 11/1984 | Maclin | |
| 4,901,522 | A | 2/1990 | Commaret et al. | |
| 5,291,732 | A * | 3/1994 | Halila | 60/796 |
| 2004/0250549 | A1 * | 12/2004 | Liebe | 60/804 |

FOREIGN PATENT DOCUMENTS

| | | |
|---|---|---|
| EP | 1 239 117 A2 | 9/2002 |
| EP | 1 528 322 A2 | 5/2005 |
| WO | WO 98/13645 A1 | 4/1998 |

* cited by examiner

*Primary Examiner* — William Rodriguez
*Assistant Examiner* — Andrew Nguyen

(57) ABSTRACT

In a combustion chamber wall for a combustion chamber having a combustion chamber outlet through which a hot combustion exhaust gas can exit the combustion chamber, the combustion chamber wall comprises an outlet end which surrounds the combustion chamber outlet, and the outlet end is provided with a tempering device.

10 Claims, 4 Drawing Sheets

COMBUSTION CHAMBER WALL, GAS TURBINE INSTALLATION AND PROCESS FOR STARTING OR SHUTTING DOWN A GAS TURBINE INSTALLATION

CROSS REFERENCE TO RELATED APPLICATIONS

This application is the US National Stage of International Application No. PCT/EP2006/062181, filed May 10, 2006 and claims the benefit thereof. The International Application claims the benefits of European application No. 05010539.4 filed May 13, 2005, both of the applications are incorporated by reference herein in their entirety.

FIELD OF INVENTION

The underlying invention relates to a combustion chamber wall for a combustion chamber, in particular an external wall of the combustion chamber for a can-type combustion chamber or an annular combustion chamber having a combustion chamber outlet through which a hot combustion exhaust gas can exit the combustion chamber, with the combustion chamber wall comprising an outlet end which surrounds the combustion chamber outlet. The combustion chamber wall can be developed both as a support structure and as a hot gas delimitation against the hot gases occurring in a gas turbine installation. In addition, the underlying invention relates to a gas turbine installation as well as a process for starting or shutting down a gas turbine installation.

BACKGROUND OF THE INVENTION

The outlet end of a combustion chamber wall, in particular the outlet end of an external wall of the combustion chamber of a gas turbine combustion chamber (also called aft end) heats up substantially more slowly during the starting process than the remainder of the combustion chamber wall. During the starting phase, the slower heating up leads to a smaller thermal expansion of the combustion chamber wall at its outlet end compared to the remaining regions. If the external wall is divided, then the outlet end can be drawn inward due to the different heating up. On account of the varying thermal expansion, deformations result that can in turn lead to high mechanical stresses on the outlet end. For example, the smaller thermal expansion of the outlet end in a rotationally symmetrical combustion chamber with a circular outlet end leads to a constriction on the outlet end and for this reason to an ovalization of the combustion chamber cross section on the outlet end.

The high stresses arising due to the uneven deformation can in particular in the transition section between the outlet end and an adjacent region with passage openings for the passage of compressed air of the compressor mass air flow through the combustion chamber wall, damage the supporting structure thereof.

There is also the fact that axially symmetrical combustion chambers usually have external wall of the combustion chambers embodied in two parts, which are screwed to one another along an axial external line by means of screws. The high mechanical stresses developing when starting the gas turbine in the transition region between the outlet end and the remainder of the combustion chamber wall can exceed the load limit of the screw situated directly on the outlet end. Therefore, this screw can be exposed to enormous bending loads, which at the end of the day can lead to the destruction of the screw.

In addition, the turbine guide vanes of the first vane ring of the turbine are frequently integrated in the outlet end of the combustion chamber, for example by being screwed to the outlet end of combustion chamber walls, in particular to the outlet end of external wall of the combustion chambers. A deformation of the outlet end leads to a shift of these guide vanes. For example, the turbine blades in an annular combustion chamber, in the case of which the above-mentioned ovalization occurs, would shift in a radial manner according to the ovalization. Therefore, provision must be made for a large gap between the outlet end and the guide vanes in order that the guide vanes can shift and for this reason that the blades do not knock against the housing. In this process, the size of the gap is measured in accordance with the deformations of the outlet end occurring during the transient conditions of the gas turbine installation and in particular when starting the gas turbine installation. However, a large gap causes problems when creating a seal concept within the transition region between the turbine guide vanes and the combustion chamber wall, which must be taken into account in the case of the seal concept. Besides, a large gap means that a relatively large amount of working medium of the gas turbine installation can exit the combustion chamber via the gap. Since the exiting working medium for propelling the turbine is lost, a large gap reduces the efficiency of the gas turbine installation.

SUMMARY OF INVENTION

The object underlying the present invention is thus to make available a combustion chamber wall, in particular an external wall of the combustion chamber, and a gas turbine installation by means of which the problems can be reduced.

A further object underlying the present invention is to make available a process for starting a gas turbine installation, in which the problems mentioned above occur to a less serious degree.

The first object is achieved by means of a combustion chamber wall or a gas turbine installation and the second object by a process for starting a gas turbine installation. The dependent claims contain advantageous developments of the combustion chamber wall or the process.

A combustion chamber wall as claimed in the invention for a combustion chamber having a combustion chamber outlet through which a hot combustion exhaust gas can exit the combustion chamber, the combustion chamber wall comprises an outlet end which surrounds the combustion chamber outlet and the outlet end is provided with a tempering device, thus a heating device and/or a cooling device. The combustion chamber wall can be configured in particular for forming an external wall of the combustion chamber either alone or in connection with at least one further combustion chamber wall.

In combustion chamber walls according to the prior art the fact that the outlet end of the combustion chamber wall heats up more slowly than the remainder of the wall is due to the fact that mass flow air from the compressor of the gas turbine installation flows around the combustion chamber wall except within the region of the outlet end of the compressor. However, the compressor air conveyed to the combustion chamber wall is preheated so that the compressor mass air flow brings about a heating of the regions of the combustion chamber wall around which it flows at the beginning of the starting process. On the other hand, the outlet end around which said air flow does not flow is not heated up by the compressor mass air flow.

The underlying invention is thus based on the insight that a difference in the temperature between the outlet end and the combustion chamber wall can be reduced if the outlet end of the combustion chamber wall is arranged in such a way that it can be kept at a moderate temperature, thus can be heated or cooled. Differences in the temperature between the outlet end and the adjacent remaining regions of the combustion chamber wall can be adapted to one another. The decrease of the difference in the temperature leads to an adjustment of the thermal expansion and for this reason to a decrease of the stresses in the transition region. As a result, the relative gap between the outlet end and the guide vanes fastened to it can be reduced and for this reason the efficiency of the gas turbine installation be increased.

Keeping at a moderate temperature, thus heating or cooling the outlet end can be achieved in a relatively simple manner in terms of its design by the fact that the tempering device, for the outlet end, comprises fluid channels, which are interconnected by means of a tempering fluid supply, thus a heating fluid supply and/or a cooling fluid supply. The tempering fluid is preferably the compressor mass air flow or a portion of the compressor mass air flow. If air from the compressor mass air flow is used as a tempering fluid, then it is thereby possible to bring about, in a particularly simple and elegant way, an adjustment of the temperature of the outlet end to the directly adjacent regions of the combustion chamber wall.

Combustion chambers frequently exhibit a rotational symmetry so that they have an axial direction and a circumferential direction. In the annular combustion chamber of a gas turbine, the axial direction would for example be given by the axis of the turbine shaft, on the other hand in a silo combustion chamber by the direction of flow of the combustion exhaust gases in the combustion chamber. Likewise an axial direction and a circumferential direction can also be specified accordingly for the combustion chamber walls of which these combustion chambers are composed. In such a combustion chamber wall, the fluid channels can run at least partially in an axial direction through the outlet end.

The combustion chamber wall has an outside, which after the installation in a gas turbine installation, in particular faces the combustion chamber plenum of the installation and said wall also has an inside, which faces the interior of the combustion chamber. Therefore, in the combustion chamber wall, fluid channels are then provided which have openings that open out towards the outside of the combustion chamber wall, i.e. openings, which after the installation in a gas turbine installation open out into the combustion chamber plenum. In addition, fluid channels with openings that open out towards the interior of the combustion chamber are also present, which are connected in the flow system to the openings which open out into the combustion chamber plenum. The flow connection of the said openings makes it possible to convey the tempering fluid into flow passages which are formed between the combustion chamber wall and the thermal shield elements pointing towards the interior of the combustion chamber after it passes through the outlet end of the combustion chamber wall. If the compressor medium is for example used as the tempering fluid, a cooling of the thermal shield elements can be achieved in particular with this arrangement in the region of the combustion chamber adjoining the outlet end for stationary gas turbine conditions. In the case of combustion chamber walls according to the prior art, this would be achieved with difficulty.

In terms of design, the flow connection can for example thus be achieved by means of the fact that all the fluid channels in addition have openings which open out into a groove which is arranged in one section of the outlet end facing the turbine stage of a gas turbine installation and which runs in a circumferential direction around the combustion chamber wall. The groove must be covered with at least one covering element and in the covered condition forms a flow passage together with said covering element. This embodiment makes it possible to have recourse to a proven sealing concept in which a seal is arranged around the outlet end of the combustion chamber wall. The purpose of the seal is to seal the turbine section of the gas turbine installation against the higher pressure in the combustion chamber plenum. A failure of the seal would lead to a leakage mass flow as a result of which a further operation of the gas turbine installation would not be possible. By means of the proven sealing concept, a failure of the seal can be prevented in a reliable manner. The seal can be arranged in particular between the openings of the fluid channels opening into the combustion chamber plenum and the combustion chamber outlet without deviating from the proven sealing concept.

The combustion chamber wall in accordance with the invention can in particular be equipped as an external wall of the combustion chamber of an annular combustion chamber for gas turbine installations. A gas turbine installation in accordance with the invention then comprises a combustion chamber plenum with at least one combustion chamber arranged therein and one turbine stage connected in the flow system downstream of the combustion chamber. The combustion chamber has at least one combustion chamber wall in accordance with the invention. As an alternative, the combustion chamber wall can also be arranged in a can-type combustion chamber.

In a particularly advantageous development of the gas turbine installation, the combustion chamber wall comprises fluid channels which have openings that open out into the combustion chamber plenum on the outside of the combustion chamber wall. In addition, the fluid channels have openings that open out towards the interior of the combustion chamber which are connected in the flow system to the openings that open out into the combustion chamber plenum. In terms of the design, this can for example be implemented by all the fluid channels having additional openings, which open out into a groove, which is present in one section of the outlet end facing a turbine stage. A flow passage is formed by covering the groove by means of a covering element. Via the openings and the fluid channels arranged in the outside of the combustion chamber wall, compressor air can then flow from the combustion chamber plenum into the groove. From the groove, the compressor air can then be conveyed via further fluid channels and openings facing the interior of the combustion chamber in the direction of the interior of the combustion chamber. In this development, the combustion chamber plenum can be sealed from the turbine stage by means of a leak-tight seal surrounding the outlet end of the combustion chamber wall. The seal surrounds the outlet end in the region between the section of the outlet end facing the turbine stage and the openings of the fluid channels that open out into the combustion chamber plenum. It can in particular be arranged between a turbine guide vane carrier surrounding the outlet end of the combustion chamber wall and the outlet end of the combustion chamber wall.

In the process in accordance with the invention for starting or shutting down a gas turbine installation with a combustion chamber, having a combustion chamber outlet through which a hot combustion exhaust gas can exit the combustion chamber, the combustion chamber wall comprises an outlet end which surrounds the combustion chamber outlet, and the outlet end is tempered during the starting or shutting down process.

Tempering of the outlet end reduces the deformation and stresses in the transition region between the outlet end and the remainder of the combustion chamber wall. In cases of a radially symmetrical combustion chamber wall, such as for instance the external wall of the combustion chamber of an annular combustion chamber, the already mentioned ovalization can thus be reduced in this way. In addition, the decrease of the ovalization leads to a decrease of the relative gap between the combustion chamber wall and the turbine guide vanes screwed thereto, whereby cooling concepts can be implemented more simply. Besides, the efficiency of the gas turbine installation is also increased and a smaller load from the screws arranged in the proximity of the outlet end occurs for fastening combustion chamber half walls by means of screws to one another.

Tempering the outlet end can be achieved by a tempering fluid being conveyed through fluid channels arranged in the outlet end. As the tempering fluid at least one part of the compressor mass flow can in particular be conveyed by means of fluid channels.

Both the combustion chamber wall in accordance with the invention and the process in accordance with the invention result overall in an increase of the life span of the combustion chamber supporting structure in the region of the combustion chamber outlet as well as in a reduction of the load of the thermal shield elements carrying hot gas arranged in this region on the inside of the combustion chamber wall.

BRIEF DESCRIPTION OF THE DRAWINGS

Further features, characteristics and advantages of the underlying invention emerge from the description given below of an exemplary embodiment with reference to the associated drawings.

DETAILED DESCRIPTION OF INVENTION

Figure 1:
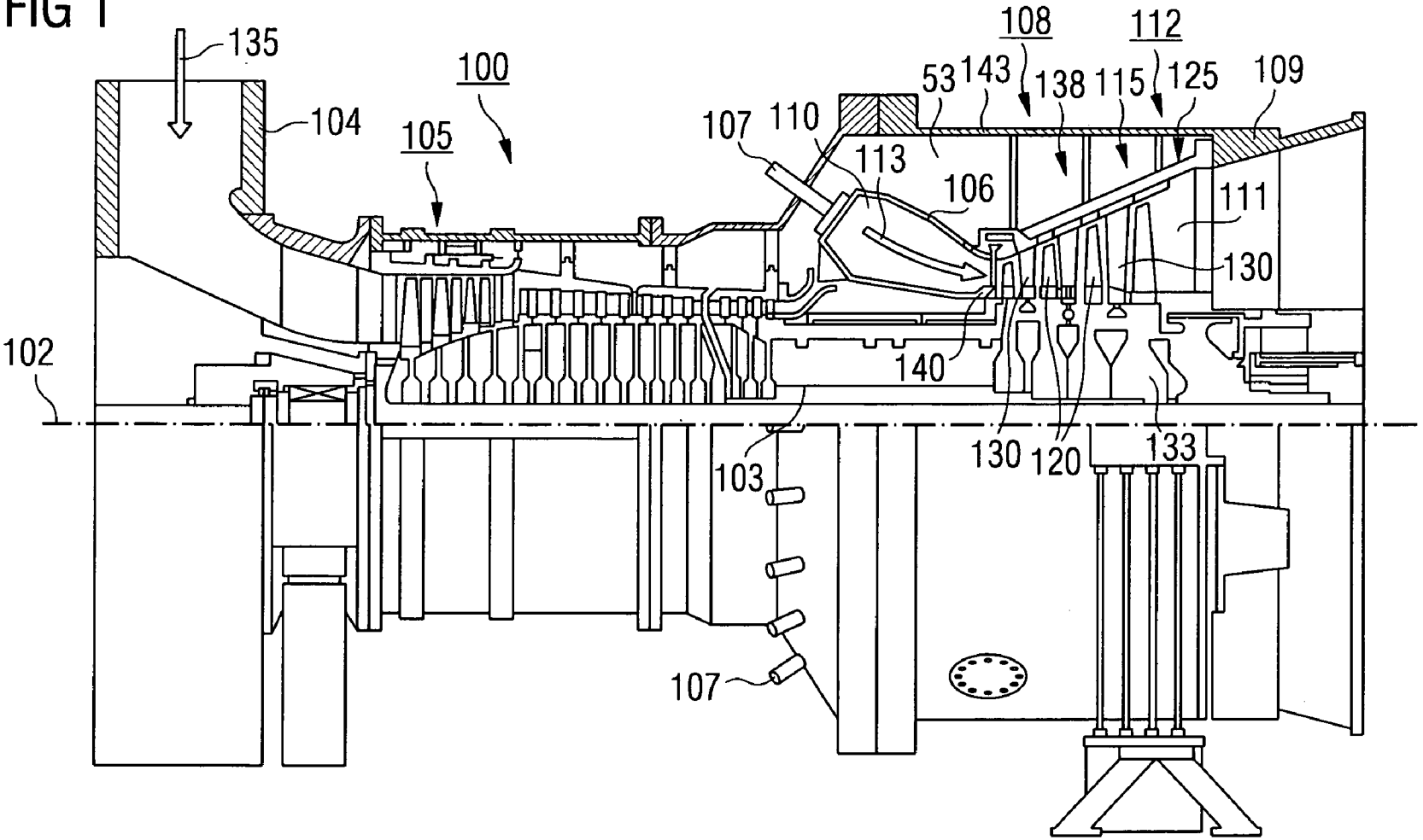
FIG. 1 shows a gas turbine installation in a partly cut-away side view.

FIG. 1 for example is a longitudinal sectional view of a gas turbine 100. The gas turbine 100 features in its interior a rotor 103 that is arranged rotatably mounted around an axis of rotation 102, which is also called a turbine rotor. Along the rotor 103, an intake housing 104, a compressor 105, for example a torus-like combustion chamber 110, in particular an annular combustion chamber 106, with a plurality of coaxially arranged burners 107, a turbine 108 and a waste gas housing 109 follow one another along said rotor.

The annular combustion chamber 106 communicates for example with an annular hot-gas conduit 111. There, for example four turbine stages 112 connected in series form the turbine 108.

Each turbine stage 112 is for example formed from two blade rings. In the hot-gas conduit 111, seen in the direction of flow of a working medium 113, a row 125 formed from rotor blades 120 follows a guide vane row 115.

The guide vanes 130 are fastened to an interior housing 138 of a stator 143, whereas the rotor blades 120 of a row 125 are for example attached by means of a turbine disk 133 to the rotor 103.

A generator or a machine is for example coupled to the rotor 103 (not shown).

During the operation of the gas turbine 100, air 135 is sucked in through the intake housing 104 and compressed by the compressor 105. The compressed air made available on the turbine-specific end of the compressor 105 is conveyed to the burners 107 and mixed with a fuel there. The mixture then combusts in the combustion chamber 110 while producing the working medium 113. From there, the working medium 113 flows along the hot-gas conduit 111, past the guide vanes 130 and the rotor blades 120. At the rotor blades 120, the working medium 113 is relieved in an impulse-transferring manner so that the rotor blades 120 propel the rotor 103 and the machine coupled to it.

Those components exposed to the hot working medium 113 are subject to thermal loads during the operation of the gas turbine 100. The guide vanes 130 and the rotor blades 120 of the first turbine stage 112 seen in the direction of flow of the working medium 113 are thermally loaded the most in addition to the thermal shield blocks lining the annular combustion chamber 106.

In order to withstand the temperatures prevailing there, these can be cooled by means of a cooling medium.

Figure 2:
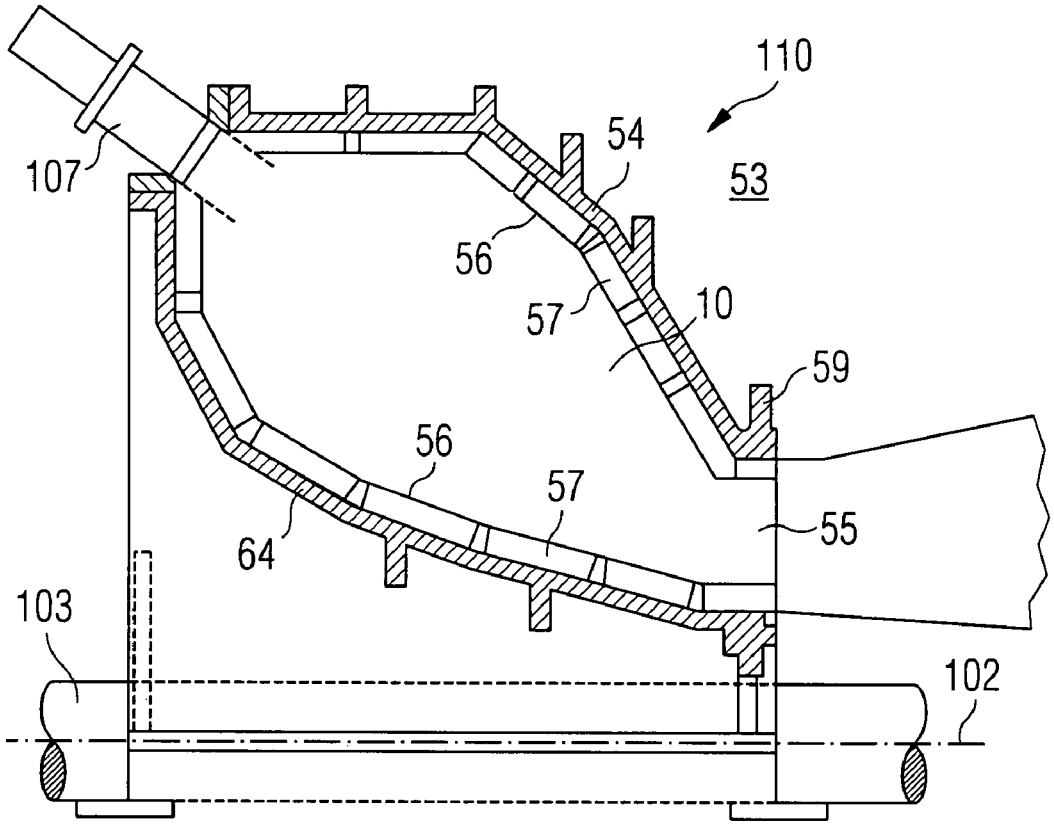
FIG. 2 shows the combustion chamber of a gas turbine installation in a cut-away side view.

FIG. 2 shows a section from the annular combustion chamber 110 in an enlarged view. The annular combustion chamber 110 comprises an external wall of the combustion chamber 54 as well as an inner wall of the combustion chamber 64, which limit the combustion chamber 51 in the direction of the shaft 8. In addition, in FIG. 2 thermal shield elements 56 positioned on the combustion chamber walls facing towards the interior of the combustion chamber can also be seen. The thermal shield elements 56 not only serve to protect the combustion chamber walls 54, 64 against excessive thermal stress during the operation of the gas turbine installation, but also to convey the expanding hot combustion exhaust gases to the combustion chamber outlet 55.

Between the thermal shield elements and the external walls of the combustion chamber 54, 64, flow passages 57 are formed through which a cooling medium is conveyed for cooling the thermal shield element 56. The cooling medium enters through passage openings 58 in the external wall of the combustion chamber 54 which are arranged in the proximity of the combustion chamber outlet 55 (see FIG. 3), the flow passage 57 between the external wall of the combustion chamber 54 and the thermal shield elements 56 and then flows either to the burner 52, where it is mixed with the supplied fuel for combustion or is directly introduced into the combustion chamber 110 through the gap between the thermal shield elements 56, in order to close the gap against the penetration of hot combustion exhaust gases.

Compressor air is used as the cooling fluid, i.e. at least one part of the compressor mass air flow is introduced via the combustion chamber plenum 53 through the supply openings 58 into the flow passage 57 between the thermal shield elements 56 and the external wall of the combustion chamber 54.

The compressed air is usually already preheated, on the one hand due to the compression process and on the other hand, if necessary, also by means of a preheating device via which the heat of the exhaust gas emerging from the turbine stage 112 will be transferred to the compressed air. If preheating is undertaken by means of a preheating device, less waste heat of the gas turbine process is lost needlessly so that the efficiency of the gas turbine installation can be increased. In addition, the pollutant emissions can be decreased by means of preliminary air heating. By comparison with the temperature of the combustion exhaust gases, the temperature of the compressed air is however still low so that this can suitably serve as a cooling fluid.

While preheated air in the stationary condition of the gas turbine installation represents an outstanding cooling possibility, it on starting the gas turbine installation, thus in a transient condition, leads to a heating up of the combustion chamber walls, even then if a preheating only takes place due to the compression.

In view of the problem mentioned in the introduction, that in particular the external wall of the combustion chamber 54 in the region of the outlet end 59 on starting the gas turbine installation heats up less strongly than the adjacent ranges of the external wall of the combustion chamber 54, fluid channels are arranged in the outlet end 59 as heating channels 60, 61, through which the compressor mass air flow flows (cf. FIGS. 3 to 6).

Some of the heating channels 61 have openings 63 in the region of the outlet end 59 facing the combustion chamber plenum 53 and openings 64 in the section 65 of the outlet end 59 facing the turbine stage 112. The path of these heating channels 61 can be identified in FIG. 5, which shows a section through the outlet end 59 along the line A-A represented in FIG. 3.

Figure 3:
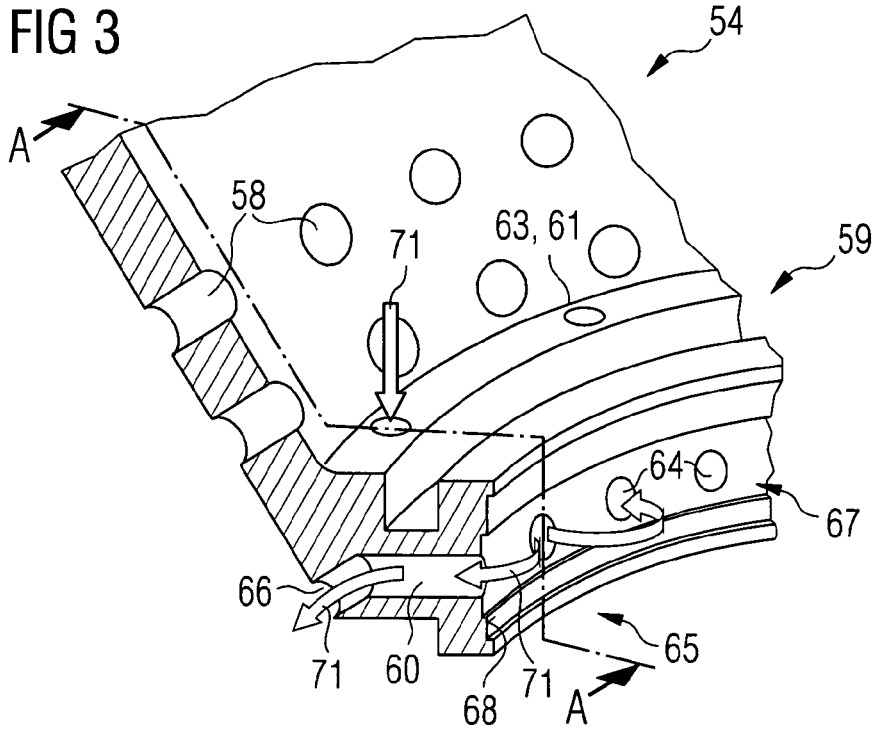
FIG. 3 shows details of the outlet end of an external wall of the combustion chamber in a cut-away perspective view.
Figure 4:
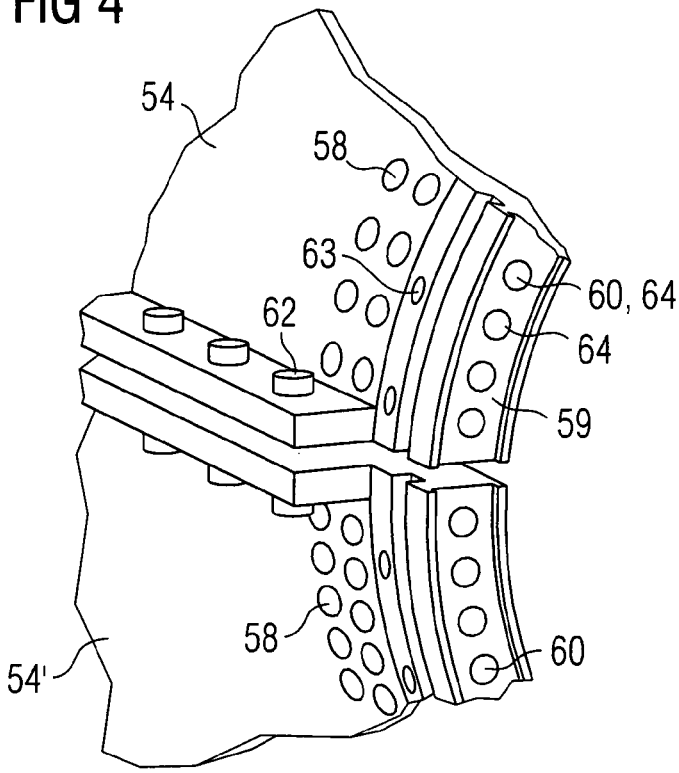
FIG. 4 shows a section of the outlet end of the combustion chamber in a simplified perspective view.
Figure 5:
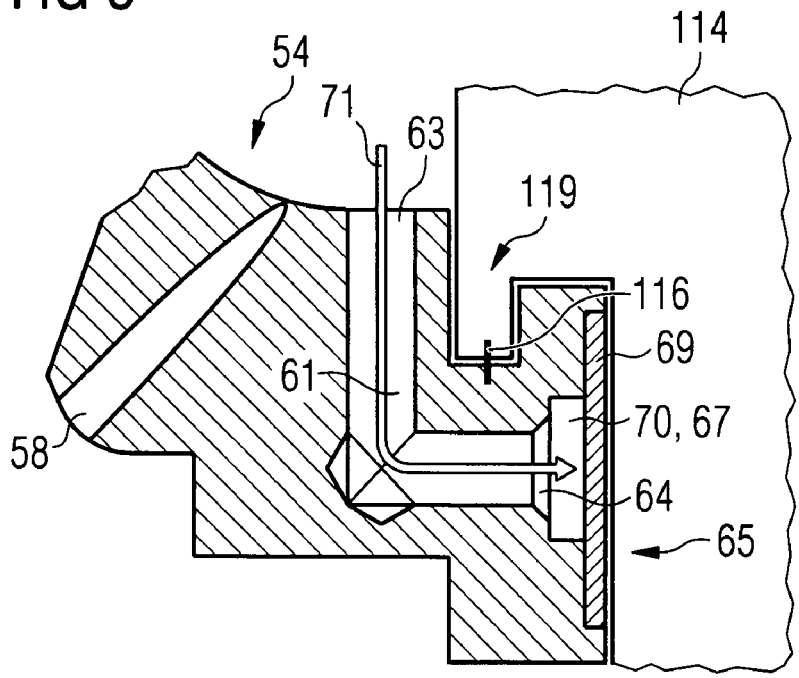
FIG. 5 shows a section through the outlet end of the combustion chamber taken along the line A-A in FIG. 3.
Figure 6:
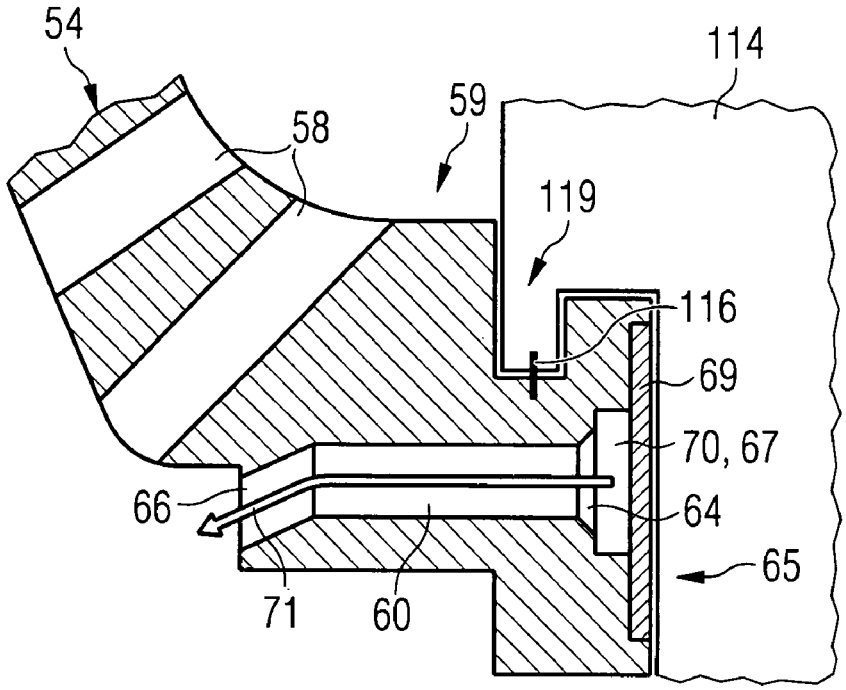
FIG. 6 shows the outlet end of the combustion chamber shown in the perspective view in FIG. 3 in an overhead view of a sectional plane.

The remaining heating channels 60, the path of which is to be identified in FIG. 3 and shown in an enlarged manner in FIG. 6, likewise have openings 64 in section 65 of the outlet end 59 facing the turbine stage 112. However, in contrast to the heating channels 61 mentioned before, the latter heating channels 60 do not have an opening 63 in the region facing the combustion chamber plenum 53. Instead they have openings 66, which open out towards the interior of the combustion chamber, in particular in the flow passages 57 between the external wall of the combustion chamber 54 and the thermal shield elements 56.

Section 65 of the outlet end 59 facing the turbine stage 112 is provided with a profile groove 67 extending in a circumferential direction around the combustion chamber wall 54, in the groove floor 68 of which, openings 64 are arranged. The profile groove 67 can be covered with a cover plate 69, it being possible that the profile of the profile groove 67 is selected in such a manner, that a flow passage 70 is formed between the groove floor 68 and the cover plate. By means of said flow passage 70, the heating channels 60 are fluidically connected to the heating channels 61—and for this reason the openings 63 that open out towards the combustion chamber plenum 53 to the openings 66 that open out towards the interior of the combustion chamber.

The flow path 71 of the compressor mass air flow as a heating fluid is indicated in FIG. 3 by means of arrows. The compressor mass air flow enters the heating channels 61 through the openings 63 facing the combustion chamber plenum 53, flows through these channels and escapes from the heating channels 61 through the openings 64 arranged in the groove floor 68 and into the flow passage 70. Here the compressor mass air flow is deflected from the cover plate 69 (not shown in FIG. 3) so that it enters the heating channels 60 through the openings 64 of heating channels 60. After having flowed through the heating channels 60, the compressor mass air flow enters through the openings 66 that open out towards the interior of the combustion chamber, the flow passages 57 formed between the external wall of the combustion chamber 54 and the thermal shield elements 56, where it can be used in particular for stationary gas turbine conditions for cooling the thermal shield elements 56. It can then be conveyed to the burner or be introduced via outlet openings in thermal shield elements 56 or via a gap between the thermal shield elements 56 into the combustion chamber 110.

The preheated compressor mass air flow, flowing as described through the outlet, results in the outlet end 59 of the external wall of the combustion chamber 54 heating up more quickly when the gas turbine installation is started up than is the case without the presence of heating channels 60, 61. The difference in the temperature between the outlet end 59 and the adjacent sections of the external wall of the combustion chamber 54 can in the first minutes of the starting process be reduced in this way and mechanical stresses on the transition from the flange of the outlet end 59 to the adjacent regions of the external wall of the combustion chamber 54 can be reduced. This, in the case of the annular combustion chamber shown, leads to a reduced ovalization of the outlet end on starting the gas turbine installation and for this reason to reduced relative gaps between the combustion chamber 51 and the turbine guide vanes attached thereto. In addition, the bending strain of screws 62 arranged in the proximity of the outlet end 59 (cf. FIG. 4), which for example interconnect two half walls 54, 54' can be reduced. In addition, the load of thermal shield elements 56 is reduced, which in the region of the outlet end 59 are fastened with screws to the external wall of the combustion chamber 54 is reduced.

The outlet end 59 of the combustion chamber wall 54 is surrounded by the turbine guide vane carrier 114 of the turbine stage 112. A section 118 of the turbine guide vane carrier 114 (FIGS. 5 and 6) engages into a peripheral groove 119 of the combustion chamber wall 54. In order to seal the turbine stage 112, in which a pressure prevails that is in the region of about 10 bar lower than that of in the combustion chamber plenum 53, from the pressure in the combustion chamber plenum 53, a seal 116 is arranged between a section 118 of the turbine guide vane carrier 114 and the root of the peripheral groove 119, which extends around the entire circumference of the combustion chamber wall 54. This sealing concept is used in particular in gas turbine installations with combustion chamber walls without fluid channels for tempering the outlet end 59 and can be taken over without change for gas turbine installations with combustion chamber walls in accordance with the invention. Existing experience concerning the assembly, maintenance and dimensioning of the seal can be taken over in such a way. In addition, a good sealing performance can be guaranteed.

As an alternative to the flow path descried above, it is also possible to set the flow conditions in such a way that the compressor mass air flow is conveyed through the openings 64 of the outlet end 59 facing the turbine stage 112 towards the turbine stage. In this case, all the heating channels can have the path represented in FIG. 5. A profile groove and a cover plate are not necessary in this development of the flow path. However, in this case an adapted sealing concept is necessary in order to make it possible that compressor air can enter the fluid channels.

In a further alternative to the flow paths described above, it is also possible to set the flow conditions in such a way that the compressor mass air flow entering through the passage openings 58; the flow passage 57 is partly steered into the heating channels 60 and conveyed from these channels to the turbine stage 112. In this way, the compressor mass air flow flowing through the heating channels 60 can in the later stationary condition of the gas turbine installation be used for cooling the outlet end 59 and the turbine stage 112, for instance the guide vanes in the turbine stage 112. In this case, all the heating channels can for example exhibit the path represented in FIG. 8. A cover plate is not necessary.

The alternative flow paths mentioned can also be combined with one another for example by dividing the outlet end 59 into sections along the circumference of the external wall of the combustion chamber 54, in which one of the described flow paths is implemented in each case.

The advantages to be achieved with the heating channels on starting the gas turbine installation also be obtained in a corresponding manner in the case of a process for shutting down the gas turbine installation and in the case of other transient gas turbine conditions, provided that these bring along a sufficiently large change in the temperature. During the shutting down process, the "heating channels" instead of leading to a faster heating of the outlet end, as is the case with the starting process, lead to a faster cooling of the outlet end. Stresses are also reduced in this case due to inhomogeneous temperature distributions.

The invention claimed is:

1. A combustion chamber wall of a combustion chamber, the combustion chamber having a combustion chamber outlet through which a hot combustion exhaust exits, the combustion chamber wall having an outlet end that surrounds the combustion chamber outlet comprising:

a tempering fluid supply that provides a tempering fluid;

a tempering device having a plurality of fluid channels connected to the tempering fluid supply;

a profile groove arranged in a section of the outlet end facing a turbine stage, a first portion of the fluid channels have a first opening arranged outside of the combustion chamber wall that opens out into a combustion chamber plenum and an outlet at the profile groove;

a second portion of fluid channels have a second opening arranged towards the interior of the combustion chamber and an inlet at the profile groove, wherein the first openings arranged on the outside of the combustion chamber wall are connected in the flow system to the second openings that open out toward the interior of the combustion chamber;

wherein all the fluid channels have openings that open out into the profile groove; and a covering element for covering the profile groove, where a flow passage is formed by the covering element covering the profile groove, wherein the outlets of the first portion of fluid channels are circumferentially offset from the inlets of the second portion of fluid channels within the profile groove.

2. The combustion chamber wall as claimed in claim 1, wherein the tempering fluid supply is a part of the compressor mass air flow.

3. The combustion chamber wall as claimed in claim 2, wherein the combustion chamber wall has an axial and a circumferential direction and the fluid channels at least partly run in an axial direction through the outlet end.

4. The combustion chamber wall as claimed in claim 3, wherein the combustion chamber wall is an external wall of an annular combustion chamber for gas turbine installations.

5. A gas turbine installation, comprising:

a combustion chamber plenum having a combustion chamber, wherein the combustion chamber has a wall with an outlet end comprising:

a tempering fluid supply that provides a tempering fluid, a tempering device having a plurality of fluid channels connected to the tempering fluid supply, a profile groove arranged in a section of the outlet end facing a turbine stage;

a first portion of the fluid channels have a first opening arranged outside of the combustion chamber wall that opens out into a combustion chamber plenum and an outlet at the profile groove;

a second portion of fluid channels have aria second opening arranged towards the interior of the combustion chamber and an inlet at the profile groove, wherein the first openings arranged on the outside of the combustion chamber wall are connected in the flow system to the second openings that open out toward the interior of the combustion chamber, wherein all the fluid channels have openings that open out into the profile groove, a covering element for covering the profile groove, where a flow passage is formed by the covering element covering the profile groove, wherein the outlets of the first portion of fluid channels are circumferentially offset from the inlets of the second portion of fluid channels within the profile groove, and a turbine stage fluidly connected downstream of the combustion chamber.

6. The gas turbine installation as claimed in claim 5, further comprising:

a seal for sealing the combustion chamber plenum from the interior of the combustion chamber and the turbine stage, and the leak-tight seal surrounds the outlet end of the combustion chamber wall in the region between the openings arranged in the outside of the combustion chamber wall and the section of the outlet end facing the turbine stage.

7. The gas turbine installation as claimed in claim 6, wherein the turbine stage comprises a turbine guide vane carrier that surrounds the outlet end of the combustion chamber wall and the seal is arranged between the turbine guide vane carrier and the outlet end of the combustion chamber wall.

8. A process for starting or shutting down a gas turbine installation with a combustion chamber having a combustion chamber outlet through which a hot combustion exhaust gas exits the combustion chamber, and a combustion chamber wall with an outlet end surrounding the combustion chamber outlet, comprising:

arranging a plurality of fluid channels of the combustion chamber wall in the outlet end;

tempering the outlet end of the combustion chamber wall during the starting or shutting down of the gas turbine; and conveying a tempering fluid through the plurality of fluid channels during the tempering of the outlet end, a profile groove arranged in a section of the outlet end facing a turbine stage;

wherein the plurality of fluid channels comprise a first portion of fluid channels including a first opening arranged outside of combustion chamber wall that opens out into a combustion chamber plenum and an outlet at the profile groove, wherein the plurality of fluid channels further comprise a second portion of fluid channels including a second opening arranged towards the interior of the combustion chamber and an inlet at the profile groove, wherein the first openings arranged on the outside of the combustion chamber wall are connected in the flow system to the second openings that open out toward the interior of the combustion chamber, and wherein the outlets of the first portion of fluid channels are circumferentially offset from the inlets of the second portion of fluid channel within the profile groove.

9. The process as claimed in claim 8, wherein the tempering fluid comprises a part of the compressor mass air flow.

10. The process as claimed in claim 9, wherein the tempering during the starting process is a preheating of the outlet end.

* * * * *